US011697919B2

(12) United States Patent
Fukuda

(10) Patent No.: US 11,697,919 B2
(45) Date of Patent: Jul. 11, 2023

(54) WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/392,797

(22) Filed: Aug. 3, 2021

(65) Prior Publication Data

US 2021/0363730 A1 Nov. 25, 2021

Related U.S. Application Data

(63) Continuation of application No. 16/879,092, filed on May 20, 2020, now Pat. No. 11,124,948.

(30) Foreign Application Priority Data

Aug. 16, 2019 (JP) ..... 2019-149393

(51) Int. Cl.
*E02F 9/22* (2006.01)
*E02F 3/84* (2006.01)

(52) U.S. Cl.
CPC ..... *E02F 9/2246* (2013.01); *E02F 3/844* (2013.01); *E02F 9/2235* (2013.01)

(58) Field of Classification Search
CPC ..... E02F 9/2289; E02F 9/2246; E02F 9/2285; E02F 9/2253
See application file for complete search history.

(56) References Cited

U.S. PATENT DOCUMENTS

| | | | | |
|---|---|---|---|---|
| 9,303,633 | B2 | 4/2016 | Maiyur et al. | |
| 11,124,948 | B2 * | 9/2021 | Fukuda | E02F 3/844 |
| 2010/0009806 | A1 | 1/2010 | Shirao et al. | |
| 2010/0317486 | A1 | 12/2010 | Hyodo et al. | |
| 2013/0256053 | A1 | 10/2013 | Shirao et al. | |
| 2016/0298315 | A1 | 10/2016 | Miyamoto et al. | |
| 2017/0284063 | A1 * | 10/2017 | Fukuda | E02F 9/2246 |
| 2020/0071911 | A1 | 3/2020 | Sato | |

FOREIGN PATENT DOCUMENTS

JP 2008-82130 4/2008

* cited by examiner

*Primary Examiner* — Abiy Teka
(74) *Attorney, Agent, or Firm* — Greenblum & Bernstein, P.L.C.

(57) ABSTRACT

A working machine includes a machine body, a traveling device provided on the machine body, a traveling motor configured to provide power to the traveling device and to be switched between a first speed and a second speed, a traveling operation member to be operated by an operator, an operation detector to detect an operation extent of the traveling operation member, a traveling pump driven in response to the operation extent to supply operation fluid to the traveling motor, a revolution detector to detect a motor revolving speed, and a controller configured to switch the traveling motor from the second speed to the first speed when the motor revolving speed is equal to or less than a deceleration threshold, and then to switch the traveling motor from the first speed to the second speed when the motor revolving speed is equal to or greater than a return threshold.

27 Claims, 6 Drawing Sheets

WORKING MACHINE

CROSS-REFERENCE TO RELATED APPLICATIONS

The present application is a continuation application of U.S. application Ser. No. 16/879,092, filed May 20, 2020, which claims priority under 35 U.S.C. § 119 to Japanese Patent Application No. P2019-149393, filed Aug. 16, 2019. The disclosure of each of these applications is herein incorporated by reference in its entirety.

BACKGROUND OF THE INVENTION

Field of the Invention

The present invention relates to a working machine.

Description of Related Art

Japanese Unexamined Patent Application No. 2008-82130 previously discloses a technique for the speed reducing and the speed increasing of a working machine. The working machine disclosed in Japanese Unexamined Patent Application No. 2008-82130 is provided with a traveling motor configured to be switched between a first speed and a second speed higher than the first speed, and a traveling switching valve configured to switch the speed of the traveling motor. Under the state where the traveling motor is set to the second speed, the automatic deceleration is performed to decelerate the traveling motor to the first speed when the pressure of the operation fluid to be supplied to the traveling device is equal to or higher than a predetermined pressure.

SUMMARY OF THE INVENTION

One aspect of the present invention is to provide a working machine, which includes a machine body, a traveling device provided on the machine body, a traveling motor configured to provide power to the traveling device and to be switched between a first speed and a second speed higher than the first speed, a traveling operation member to be operated by an operator, an operation detector to detect an operation extent of the traveling operation member, a traveling pump driven in response to the operation extent to supply operation fluid to the traveling motor, a revolution detector to detect a motor revolving speed; and a controller configured to switch the traveling motor from the second speed to the first speed when the motor revolving speed is equal to or less than a deceleration threshold, and then to switch the traveling motor from the first speed to the second speed when the motor revolving speed is equal to or greater than a return threshold.

In the working machine, the deceleration threshold is less than the return threshold, and the deceleration threshold is less than a first top revolving speed of the traveling motor switched to the first speed, for the operation extent of the traveling operation member. The first top revolving speed of the traveling motor switched to the first speed is less than a second top revolving speed of the traveling motor switched to the second speed, for the operation extent of the traveling operation member.

The controller may be configured to calculate the first top revolving speed based on the operation extent of the traveling operation member, and also to calculate the deceleration threshold and the return threshold based on the operation extent of the traveling operation member.

The working machine may further include a switch coupled to the controller and configured to allow the operator to select whether or not the traveling motor is switched between the first speed and a second speed.

Another aspect of the present invention is to provide a working machine, which includes a machine body, first and second traveling devices provided on the machine body, first and second traveling motors configured to provide power to the first and second traveling device, respectively, and to be switched between a first speed and a second speed higher than the first speed, a traveling operation member to be operated by an operator, an operation detector to detect an operation extent of the traveling operation member, first and second traveling pumps driven in response to the operation extent to supply operation fluid to the first and second traveling motor, respectively, a revolution detector to detect a first motor revolving speed of the first traveling motor and a second motor revolving speed of the second traveling motor; and a controller configured to switch both of the first and second traveling motors from the second speed to the first speed when the first traveling motor rotates forward and the second traveling motor rotates backward, and at least one of the first motor revolving speed and the second motor revolving speed is equal to or less than a first deceleration threshold.

The controller may be configured to switch both of the first and second traveling motors from the second speed to the first speed when both of the first motor revolving speed and the second motor revolving speed are equal to or greater than a first return threshold after having switched both of the first and second traveling motors from the second speed to the first speed.

In the working machine, the first deceleration threshold is less than the first return threshold, and the first deceleration threshold is less than a first top revolving speed of the first and second traveling motors switched to the first speed, for the operation extent of the traveling operation member.

The controller may be configured to calculate the first top revolving speed based on the operation extent of the traveling operation member, and also to calculate the first deceleration threshold and the first return threshold based on the operation extent of the traveling operation member.

The controller may be configured to switch both of the first and second traveling motors from the second speed to the first speed when both of the first and second traveling motors rotate forward or backward, and both of the first motor revolving speed and the second motor revolving speed are equal to or less than a second deceleration threshold.

The controller may be configured to switch both of the first and second traveling motors from the first speed to the second speed when at least one of the first motor revolving speed and the second motor revolving speed is equal to or greater than a second return threshold after having switched both of the first and second traveling motors from the second speed to the first speed. In the working machine, the first deceleration threshold may be different from the second deceleration threshold.

The controller may be configured to switch both of the first and second traveling motors from the second speed to the first speed when both of the first and second traveling motors rotate forward or backward, and both of the first motor revolving speed and the second motor revolving speed are equal to or less than a second deceleration threshold.

The controller may be configured to switch both of the first and second traveling motors from the first speed to the second speed when at least one of the first motor revolving speed and the second motor revolving speed is equal to or greater than a second return threshold after having switched both of the first and second traveling motors from the second speed to the first speed. In the working machine, the first return threshold is different from the second return threshold.

Further aspect of the present invention is to provide a working machine, which includes a machine body, first and second traveling devices provided on the machine body, first and second traveling motors configured to provide power to the first and second traveling device, respectively, and to be switched between a first speed and a second speed higher than the first speed, a traveling operation member to be operated by an operator, an operation detector to detect an operation extent of the traveling operation member, first and second traveling pumps driven in response to the operation extent to supply operation fluid to the first and second traveling motor, respectively, a revolution detector to detect a first motor revolving speed of the first traveling motor and a second motor revolving speed of the second traveling motor, and a controller configured to switch both of the first and second traveling motors from the second speed to the first speed when both of the first and second traveling motors rotate forward or backward, and both of the first motor revolving speed and the second motor revolving speed are equal to or less than a second deceleration threshold.

The controller may be configured to switch both of the first and second traveling motors from the first speed to the second speed when at least one of the first motor revolving speed and the second motor revolving speed is equal to or greater than a second return threshold after having switched both of the first and second traveling motors from the second speed to the first speed.

The working machine may further includes a switch coupled to the controller and configured to allow the operator to select whether or not the traveling motor is switched between the first speed and a second speed.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
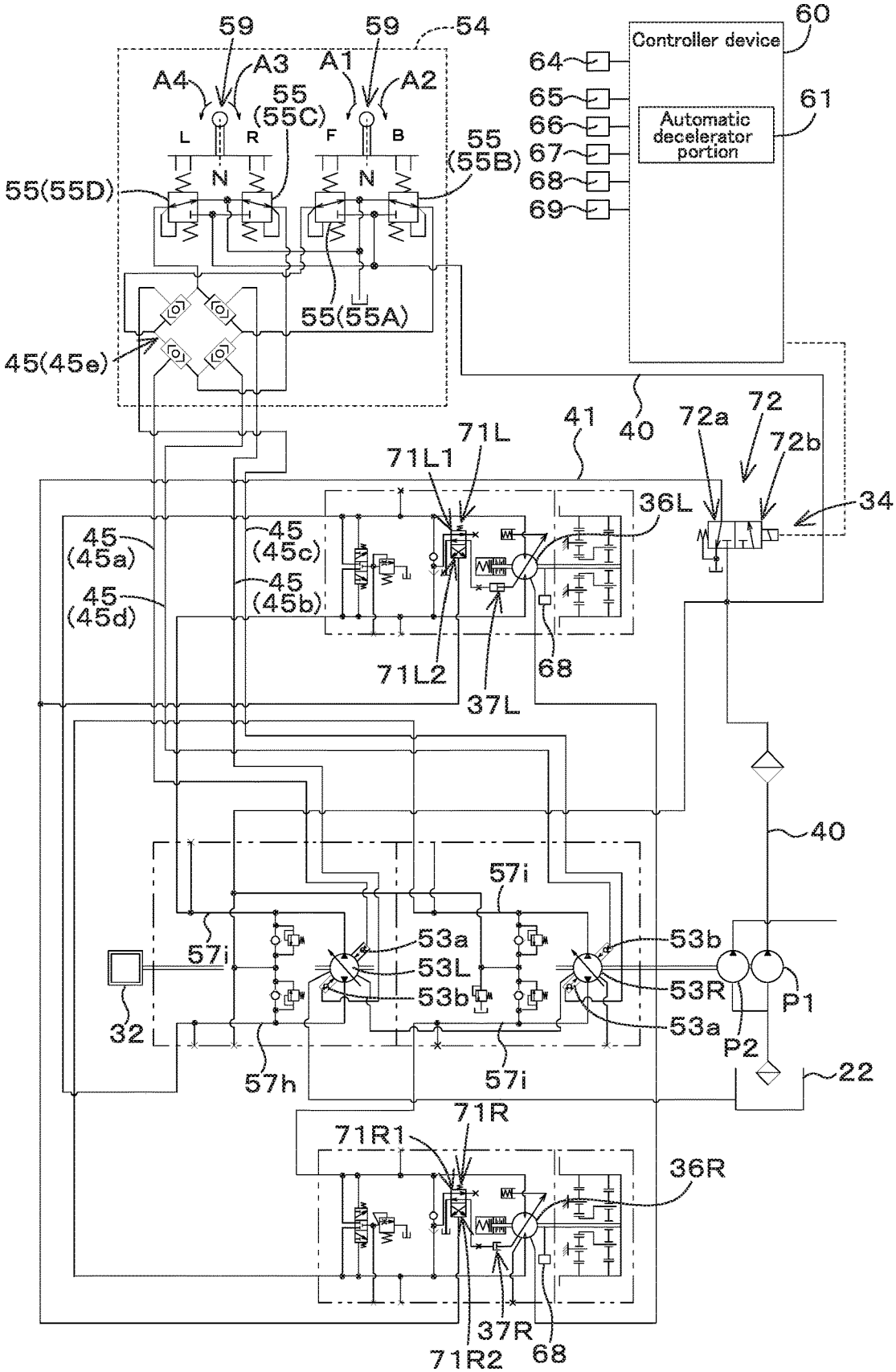
FIG. 1 is a view illustrating a hydraulic system (a hydraulic circuit) for a working machine according to embodiments of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

First Embodiment

Hereinafter, a first embodiment of a hydraulic system of a working machine according to the present invention and a working machine including the hydraulic system will be described with reference to the drawings as appropriate.

Figure 6:
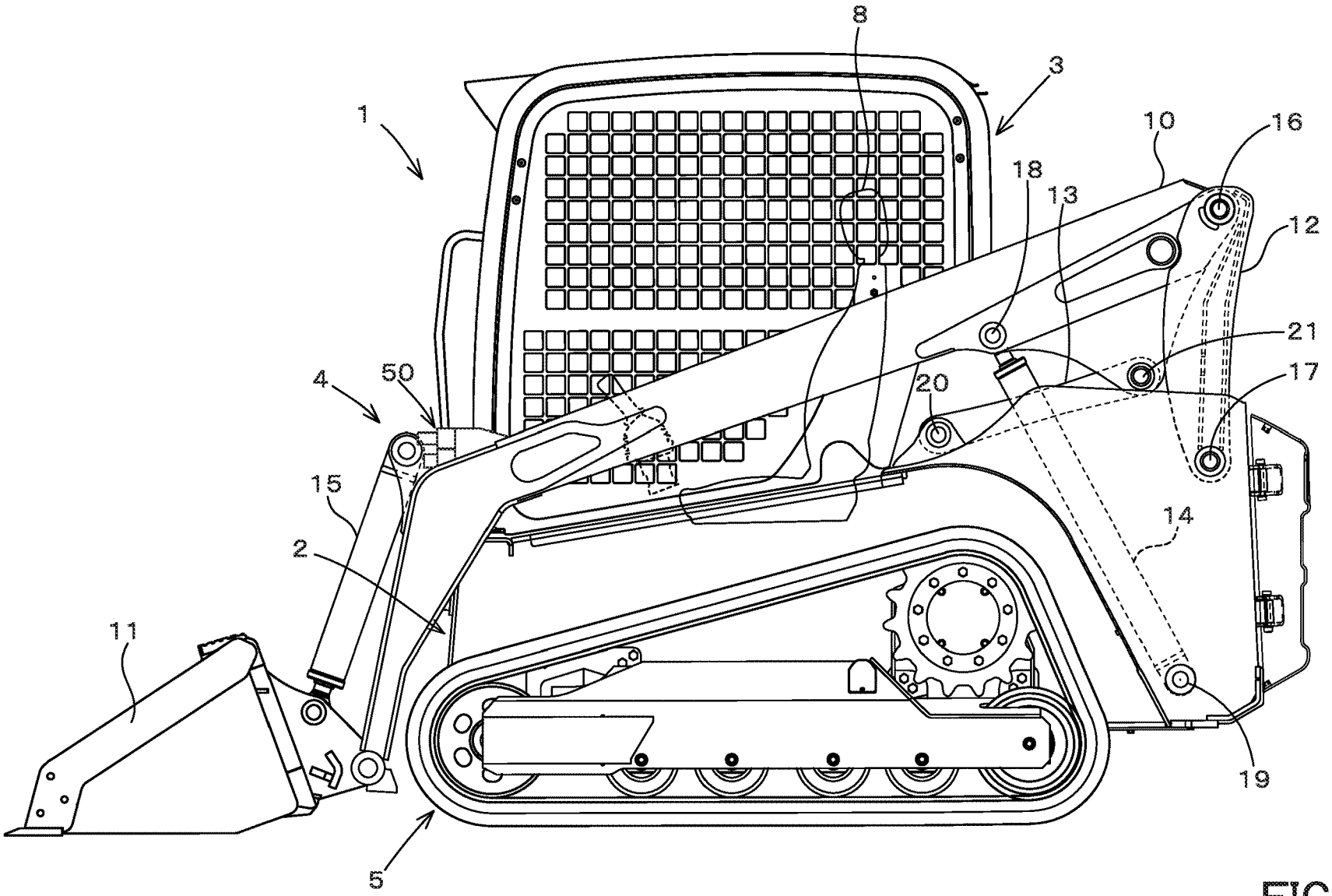
FIG. 6 is a side view illustrating a track loader that is an example of the working machine according to the embodiments.

FIG. 6 shows a side view of the working machine according to the present invention. FIG. 6 shows a compact track loader as an example of the working machine. However, the working machine according to the present invention is not limited to a compact track loader, but may be another type of loader working machine such as a skid steer loader. In addition, a working machine other than the loader working machine may be employed.

As shown in FIG. 6, a working machine 1 includes a machine body 2, a cabin 3, a working device 4, and a pair of traveling devices 5L and 5R.

In the description of the embodiment, the front side (the left side in FIG. 6) of the operator seating on the operator seat 8 of the working machine 1 is referred to as the front, the rear side (the right side in FIG. 6) of the operator is referred to as the rear, the left side (the front surface side of FIG. 6) of the operator is referred to as the left, and the right side (the back surface side of FIG. 6) of the operator is referred to as the right. In addition, a horizontal direction that is a direction orthogonal to the front-rear direction will be described as a machine width direction.

A direction extending from the center portion of the machine body 2 to the right or to the left will be described as a machine outward direction. In other words, the machine outward direction corresponds to the machine width direction, and is a direction separating away from the machine body 2.

A direction opposite to the machine outward direction will be referred to as a machine inward direction. In other words, the machine inward direction corresponds to the machine width direction, and is a direction approaching the machine body 2.

The cabin 3 is mounted on the machine body 2. The cabin 3 is provided with an operator seat 8. The working device 4 is attached to the machine body 2. The pair of traveling devices 5L and 5R are provided on outer sides of the machine body 2. A prime mover 32 is mounted in a rear portion of the machine body 2.

The working device 4 includes a boom 10, a working tool 11, a lift link 12, a control link 13, a boom cylinder 14, and a bucket cylinder 15.

The boom 10 is provided on the right side of the cabin 3 so as to be vertically swingable, and another boom 10 is provided on the left side of the cabin 3 so as to be vertically swingable. The working tool 11 is, for example, a bucket, and the bucket 11 is provided at the tip end portion (the front end portion) of the boom 10 so as to be vertically swingable. The lift link 12 and the control link 13 support a base portion (a rear portion) of the boom 10 so that the boom 10 can swing up and down.

The boom cylinder 14 is stretched and shortened to move the boom 10 up and down. The bucket cylinder 15 is stretched and shortened to swing the bucket 11.

The front portion of the boom 10 arranged to the right and the front portion of the boom 10 arranged to the left are connected to each other by a deformed connector pipe. The base portions (the rear portions) of the booms 10 are connected by a circular connector pipe.

A pair of the lift link 12, the control link 13, and the boom cylinder 14 is provided to the left corresponding to the boom arranged to the left, and another pair of the lift link 12, the control link 13, and the boom cylinder 14 is provided to the right corresponding to the boom arranged to the right, respectively.

The lift link 12 is provided extending in a vertical direction at the rear portion of the base portion of each of the booms 10. The upper portion (one end side) of the lift link 12 is pivotally supported rotatably around a lateral axis by a pivot shaft 16 (a first pivot shaft) near a rear portion of the base portion of each of the booms 10.

In addition, a lower portion (the other end side) of the lift link 12 is pivotally supported rotatably around a lateral axis by a pivot shaft 17 (a second pivot shaft) near a rear portion of the machine body 2. The second pivot shaft 17 is provided below the first pivot shaft 16.

The upper portion of the boom cylinder 14 is pivotally supported rotatably about a lateral axis by a pivot shaft 18 (a third pivot shaft). The third pivot shaft 18 is provided to the base portion of each of the booms 10, particularly provided at the front portion of the base portion.

The lower portion of the boom cylinder 14 is pivotally supported rotatably around a lateral axis by a pivot shaft 19 (a fourth pivot shaft). The fourth pivot shaft 19 is provided below the third pivot shaft 18 and near the lower rear portion of the machine body 2.

The control link 13 is provided in front of the lift link 12. One end of the control link 13 is pivotally supported rotatably around a lateral axis by a pivot shaft 20 (a fifth pivot shaft).

The fifth pivot shaft 20 is provided in the machine body 2 and at a position corresponding to the front of the lift link 12.

The other end of the control link 13 is pivotally supported rotatably around a lateral axis by a pivot shaft 21 (a sixth pivot shaft).

The sixth pivot shaft 21 is provided in the boom 10, in front of the second pivot shaft 17, and above the second pivot shaft 17.

By stretching and shortening the boom cylinder 14, each of the booms 10 swings up and down around the first pivot shaft 16 while the base portion of each of the booms 10 is supported by the lift link 12 and the control link 13, and thus the tip end portion of each of the booms 10 moves up and down.

The control link 13 swings up and down around the fifth pivot shaft 20 in synchronization with each of the booms 10 swinging up and down. The lift link 12 swings back and forth around the second pivot shaft 17 in synchronization with the control link 13 swinging vertically.

Another working tool can be attached to the front portion of each of the booms 10 instead of the bucket 11. Another working tool is, for example, an attachment (an auxiliary attachment) such as a hydraulic crusher, a hydraulic breaker, an angle broom, an earth auger, a pallet fork, a sweeper, a mower, and a snow blower.

A connector member 50 is provided at the front portion of the boom 10 arranged to the left. The connector member 50 is a device that connects a hydraulic device mounted on the auxiliary attachment to a first pipe member such as a pipe provided on the boom 10.

In particular, the first pipe member can be connected to one end of the connector member 50, and a second pipe member connected to a hydraulic device of the auxiliary attachment can be connected to the other end of the connector member 50. In this manner, operation fluid (hydraulic oil) flowing through the first pipe material is supplied to the hydraulic device through the second pipe material.

The bucket cylinders 15 are respectively arranged near the front portions of the booms 10. The bucket cylinder 15 is stretched and shortened to swing the bucket 11.

Of the pair of traveling devices 5L and 5R, the traveling device 5L is provided to the left side of the machine body 2, and the traveling device 5R is provided to the right side of the machine body 2. In the present embodiment, a crawler type traveling device (including semi-crawler type) is employed as the pair of traveling devices 5L and 5R.

Note that a wheel-type traveling device having a front wheel and a rear wheel may be employed. Hereinafter, for convenience of the explanation, the traveling device 5L may be referred to as a left traveling device 5L, and the traveling device 5R may be referred to as a right traveling device 5R.

The prime mover 32 is an internal combustion engine such as a diesel engine or a gasoline engine, an electric motor, or the like. In this embodiment, the prime mover 32 is the diesel engine, but is not limited thereto.

Next, the hydraulic system for the working machine will be described below.

As shown in FIG. 1, the hydraulic system for the working machine includes a first hydraulic pump P1 and a second hydraulic pump P2. The first hydraulic pump P1 is a pump configured to be driven by the power of the prime mover 32, and is constituted of a fixed displacement gear pump.

The first hydraulic pump P1 is configured to output the operation fluid stored in the tank 22. In particular, the first hydraulic pump P1 outputs the operation fluid to be mainly used for the controlling.

For convenience of the explanation, the tank 22 for storing the operation fluid may be referred to as a operation fluid tank. Of the operation fluid outputted from the first hydraulic pump P1, the operation fluid to be used for the controlling may be referred to as pilot fluid (pilot fluid), and the pressure of pilot fluid may be referred to as a pilot pressure.

The second hydraulic pump P2 is a pump configured to be driven by the power of the prime mover 32, and is constituted of a fixed displacement gear pump. The second hydraulic pump P2 is configured to output the operation fluid stored in the tank 22, and supplies the operation fluid to a fluid tube (a fluid line) of a working system, for example.

For example, the second hydraulic pump P2 supplies the operation fluid to a boom cylinder 14 for moving the boom 10, a bucket cylinder 15 for moving the bucket, and a control valve (a flow rate control valve) that controls the auxiliary hydraulic actuator for moving the auxiliary hydraulic actuator.

In addition, the hydraulic system for the working machine includes a pair of traveling motors 36L and 36R and a pair of traveling pumps 53L and 53R. The pair of traveling motors 36L and 36R are motors that transmit power to the pair of traveling devices 5L and 5R.

Of the pair of traveling motors 36L and 36R, the traveling motor 36L transmits a rotational power to the traveling device (the left traveling device) 5L, and the traveling motor 36R transmits a rotational power to the traveling device (the right traveling device) 5R.

The pair of traveling pumps 53L and 53R are pumps to be driven by the power of the prime mover 32, and are variable displacement axial pumps of swash plate type, for example.

The pair of travel pumps 53L and 53R are driven to supply an operation fluid to each of the pair of traveling motors 36L and 36R.

Of the pair of traveling pumps 53L and 53R, the traveling pump 53L supplies the operation fluid to the traveling pump 53L, and the traveling pump 53R supplies the operation fluid to the traveling pump 53R.

Hereinafter, for convenience of the explanation, the traveling pump 53L may be referred to as a left traveling pump 53L, the traveling pump 53R may be referred to as a right traveling pump 53R, the traveling motor 36L may be referred to as a left traveling motor 36L, and the traveling motor 36R may be referred to as a right traveling motor 36R.

Each of the left traveling pump 53L and the right traveling pump 53R has a forward-traveling pressure receiving portion 53*a* and a backward-traveling pressure receiving portion 53*a* to which the pressure (a pilot pressure) of the operation fluid (the pilot fluid) from the first hydraulic pump P1 is applied.

The angles of the swash plates are changed by the pilot pressures applied to the pressure receiving portions 53*a* and 53*b*. By changing the angles of the swash plates, it is possible for the left traveling pump 53L and the right traveling pump 53R to change the outputs (the output rates of operation fluid) and the output directions of the operation fluid.

The left traveling pump 53L and the left traveling motor 36L are connected by a connector fluid tube 57*h*, and the operation fluid outputted by the left traveling pump 53L is supplied to the left traveling motor 36L.

The right traveling pump 53R and the right traveling motor 36R are connected by a connector fluid tube 57*i*, and the operation fluid outputted by the right traveling pump 53R is supplied to the right traveling motor 36R.

The left traveling motor 36L is configured to be rotated by the operation fluid outputted from the left traveling pump 53L, and is configured to change the revolving speed (a revolving speed) in accordance with the flow rate of operation fluid. A swash plate switching cylinder 37L is connected to the left traveling motor 36L, and the revolving speed (the revolving speed) of the left traveling motor 36L can be changed by stretching and shortening the swash plate switching cylinder 37L to one side or to the other side.

That is, when the swash plate switching cylinder 37L is shortened, the revolving speed of the left traveling motor 36L is set to be in a low speed (a first speed), and when the swash plate switching cylinder 37L is stretched, the revolving speed of the left traveling motor 36L is set to be in a high speed (a second speed). That is, the revolving speed of the left traveling motor 36L can be changed between the first speed on the low speed side and the second speed on the high speed side.

The right traveling motor 36R is configured to be rotated by the operation fluid outputted from the right traveling pump 53R, and is configured to change the revolving speed (the revolving speed) in accordance with the flow rate of operation fluid. A swash plate switching cylinder 37R is connected to the right traveling motor 36R, and the revolving speed (the revolving speed) of the right traveling motor 36R can be changed by stretching or shortening the swash plate switching cylinder 37R to one side or to the other side.

That is, when the swash plate switching cylinder 37R is shortened, the revolving speed of the right traveling motor 36R is set to be in a low speed (a first speed), and when the swash plate switching cylinder 37R is stretched, the rotation of the right traveling motor 36R is set to be in a high speed (a second speed). That is, the revolving speed of the right traveling motor 36R can be changed between the first speed on the low speed side and the second speed on the high speed side.

As shown in FIG. 1, the hydraulic system for the working machine includes a traveling switching valve 34. The traveling switching valve 34 is capable of being switched between a first state in which the revolving speeds (the revolving speeds) of the traveling motors (the left traveling motor 36L and the right traveling motor 36R) are set to the first speed and a second state in which the revolving speeds are set to the second travel speed. The traveling switching valve 34 has first switching valves 71L and 71R and a second switching valve 72.

The first switching valve 71L is connected to the swash plate switching cylinder 37L of the left traveling motor 36L via a fluid tube, and is a two-position switching valve that is switched between a first position 71L1 and a second position 71L2. The first switching valve 71L shortens the swash plate switching cylinder 37L when at the first position 71L1, and stretches the swash plate switching cylinder 37L when at the second position 71L2.

The first switching valve 71R is connected to the swash plate switching cylinder 37R of the right traveling motor 36R via a fluid tube, and is a two-position switching valve that is switched between a first position 71R1 and a second position 71R2. The first switching valve 71R shortens the swash plate switching cylinder 37R when at the first position 71R1, and stretches the swash plate switching cylinder 37R when at the second position 71R2.

The second switching valve 72 is an electromagnetic valve configured to switch the first switching valve 71L and the first switching valve 71R, and is a two-position switching valve configured to be switched between a first position 72*a* and a second position 72*b* when magnetized. The second switching valve 72, the first switching valve 71L, and the first switching valve 71R are connected by the fluid tube 41.

The second switching valve 72 switches the first switching valve 71L and the first switching valve 71R to the first positions 71L1 and 71R1 when it is at the first position 72*a*, and switches the first switching valve 71L and the first switching valve 71R1 to the second positions 71L2 and 71R2 when it is at the second position 72*b*.

That is, when the second switching valve 72 is at the first position 72*a*, the first switching valve 71L is at the first position 71L1, and the first switching valve 71R is at the first position 71R1, the traveling switching valve 34 turns into the first state, and the revolving speeds of the traveling motors (the left traveling motor 36L and the right traveling motor 36R) are set to the first speed.

When the second switching valve 72 is at the second position 72*b*, the first switching valve 71L is at the second position 71L2, and the first switching valve 71R is at the second position 71R2, the traveling switching valve 34 is in the second state, and the revolving speeds of the traveling motors (the left traveling motor 36L and the right traveling motor 36R) are set to the second speed.

Thus, the traveling motors (the left traveling motor 36L and the right traveling motor 36R) are configured to be switched between the first speed on the low speed side and the second speed on the high speed side by the traveling switching valve 34.

The operation device 54 is a device for operating the traveling pumps (the left traveling pump 53L and the right traveling pump 53R), and is configured to change the angle of the swash plate (the swash plate angle) of the traveling pump. The operation device 54 includes an traveling operation lever 59 and a plurality of operation valves 55.

The traveling operation lever 59 is an operation lever that is supported by the operation valve 55 and is configured to swing in the left-right direction (a machine width direction) or in the front-back direction. That is, the traveling operation lever 59 is configured to be operated rightward and leftward from the neutral position N with reference to the neutral position N, and is configured to be operated forward and backward from the neutral position N.

In other words, the traveling operation lever 59 is configured to swing in at least four directions with reference to the neutral position N.

For convenience of the explanation, a bi-direction to the front and the rear, that is, the front-rear direction is referred to as a first direction. In addition, a bi-direction to the right and the left, that is, the right-left direction (the machine width direction) is referred to as a second direction.

In addition, the plurality of operation valves 55 are operated in common by a single of the traveling operation lever 59. The plurality of operation valves 55 are activated in accordance with the swinging of the traveling operation lever 59. The output fluid tube 40 is connected to the plurality of operation valves 55, and the operation fluid (the pilot fluid) from the first hydraulic pump P1 can be supplied through the output fluid tube 40.

The plurality of operation valves 55 include an operation valve 55A, an operation valve 55B, an operation valve 55C, and an operation valve 55D.

When the traveling operation lever 59 is swung to a forward direction (to one side) of the front-rear direction (the first direction) (when in a forward operation), the operation valve 55A changes the pressure of the operation fluid to be outputted in accordance with an operation extent (an operation) of the forward operation.

When the traveling operation lever 59 is swung to a backward direction (to the other side) of the front-rear direction (the first direction) (when in a backward operation), the operation valve 55B changes the pressure of the operation fluid to be outputted in accordance with an operation extent (an operation) of the backward operation.

When the traveling operation lever 59 is swung to a rightward direction (to one side) of the right-left direction (the second direction) (when in a rightward operation), the operation valve 55C changes the pressure of the operation fluid to be outputted in accordance with an operation extent (an operation) of the rightward operation.

When the traveling operation lever 59 is swung to a leftward direction (to the other side) of the right-left direction (the second direction) (when in a leftward operation), the operation valve 55D changes the pressure of the operation fluid to be outputted in accordance with an operation extent (an operation) of the leftward operation.

The plurality of operation valves 55 and the traveling pumps (the left traveling pump 53L and the right traveling pump 53R) are connected by the traveling fluid tube 45. In other words, the traveling pumps (the left traveling pump 53L and the right traveling pump 53R) are hydraulic devices configured to be operated by the operation fluid outputted from the operation valves 55 (the operation valve 55A, the operation valve 55B, the operation valve 55C, and the operation valve 55D).

The traveling fluid tube 45 has a first traveling fluid tube 45*a*, a second traveling fluid tube 45*b*, a third traveling fluid tube 45*c*, a fourth traveling fluid tube 45*d*, and a fifth traveling fluid tube 45*e*. The first traveling fluid tube 45*a* is a fluid tube connected to the forward-traveling pressure receiving portion 53*a* of the traveling pump 53L. The second traveling fluid tube 45*b* is a fluid tube connected to the backward-traveling pressure receiving portion 53*b* of the traveling pump 53L.

The third traveling fluid tube 45*c* is a fluid tube connected to the forward-traveling pressure receiving portion 53*a* of the traveling pump 53R. The fourth traveling fluid tube 45*d* is a fluid tube connected to the backward-traveling pressure receiving portion 53*b* of the traveling pump 53R. The fifth traveling fluid tube 45*e* is a fluid tube connecting the operation valve 55, the first traveling fluid tube 45*a*, the second traveling fluid tube 45*b*, the third traveling fluid tube 45*c*, and the fourth traveling fluid tube 45*d*.

When the traveling operation lever 59 is swung forward (in a direction indicated by an arrowed line A1 in FIG. 1 and FIG. 2), the operation valve 55A is operated, and the pilot pressure is outputted from the operation valve 55A. This pilot pressure is applied to the pressure receiving portion 53*a* of the left traveling pump 53L through the first traveling fluid tube 45*a*, and is applied to the pressure receiving portion 53*a* of the right traveling pump 53R through the third traveling fluid tube 45*c*.

In this manner, the swash plate angles of the left traveling pump 53L and the right traveling pump 53R are changed, the left traveling motor 36L and the right traveling motor 36R rotate normally (the forward rotation), and thus the working machine 1 travels straight forward.

Figure 2:
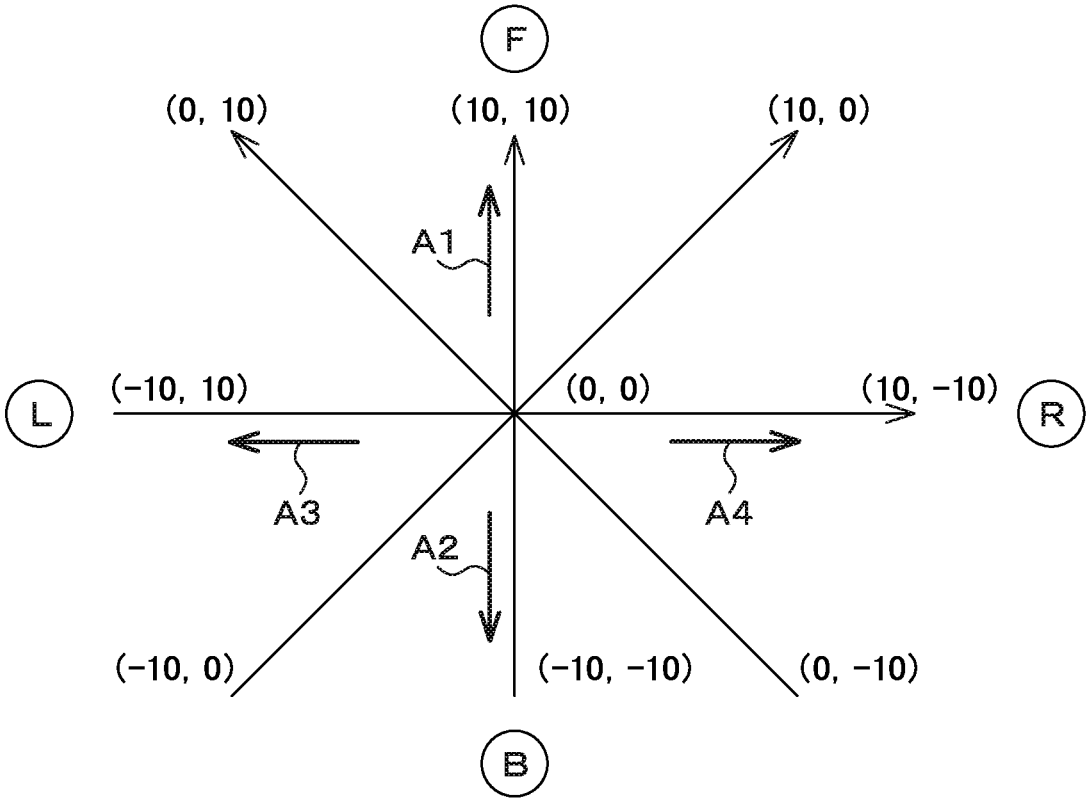
FIG. 2 is a view illustrating an operation direction of a traveling operation member according to the embodiments.

The numerical values in parentheses shown in FIG. 2 show an example of the left speed and the right speed of the working machine 1 that operates the traveling operation member 59, but the numerical values are not specifically limited.

In addition, when the traveling operation lever 59 is swung backward (in a direction indicated by an arrowed line A2 in FIG. 1), the operation valve 55B is operated, and the pilot pressure is outputted from the operation valve 55B.

This pilot pressure is applied to the pressure receiving portion 53*b* of the left traveling pump 53L through the second traveling fluid tube 45*b*, and is applied to the pressure receiving portion 53*b* of the right traveling pump 53R through the fourth traveling fluid tube 45*d*.

In this manner, the swash plate angles of the left traveling pump 53L and the right traveling pump 53R are changed, the left traveling motor 36L and the right traveling motor 36R rotate reversely (the backward rotation), and thus the working machine 1 travels straight backward.

In addition, when the traveling operation lever 59 is swung rightward (in a direction indicated by an arrowed line A3 in FIG. 1), the operation valve 55C is operated, and the pilot pressure is outputted from the operation valve 55C.

This pilot pressure is applied to the pressure receiving portion 53*a* of the left traveling pump 53L through the first traveling fluid tube 45*a*, and is applied to the pressure receiving portion 53*b* of the right traveling pump 53R through the fourth traveling fluid tube 45*d*.

In this manner, the swash plate angles of the left traveling pump 53L and the right traveling pump 53R are changed, the left traveling motor 36L rotates normally and the right traveling motor 36R rotates reversely, and thus the working machine 1 turns rightward (the pivot turning).

In addition, when the traveling operation lever 59 is swung leftward (in a direction indicated by an arrowed line A4 in FIG. 1), the operation valve 55D is operated, and the pilot pressure is outputted from the operation valve 55D.

This pilot pressure is applied to the pressure receiving portion 53*a* of the right traveling pump 53R through the third traveling fluid tube 45*c*, and is applied to the pressure receiving portion 53*b* of the left traveling pump 53L through the second traveling fluid tube 45*b*.

In this manner, the swash plate angles of the left traveling pump 53L and the right traveling pump 53R are changed, the left traveling motor 36L rotates reversely and the right traveling motor 36R rotates normally, and thus the working machine 1 turns leftward (the pivot turning).

When the traveling operation lever 59 is swung in an oblique direction, the rotational directions and the revolving speeds of the left traveling motor 36L and the right traveling motor 36R are determined depending on the differential pressure between the pilot pressure applied to the pressure receiving portion 53*a* and the pilot pressure applied to the pressure receiving portion 53*b*. Thus, the working machine 1 turns right or left while traveling forward or backward.

That is, when the traveling operation lever 59 is swung obliquely forward left, the working machine 1 turns left while traveling forward at a speed corresponding to the swing angle of the traveling operation lever 59, and when the traveling operation lever 59 is swung obliquely forward right, the working machine 1 turns right while traveling forward at a speed corresponding to the swing angle of the traveling operation lever 59.

When the traveling operation lever 59 is swung obliquely backward left, the working machine 1 turns left while traveling backward at a speed corresponding to the swing angle of the traveling operation lever 59, and when the traveling operation lever 59 is swung obliquely backward right, the working machine 1 turns right while traveling backward at a speed corresponding to the swing angle of the traveling operation lever 59.

As shown in FIG. 1, the working machine 1 includes a controller device 60. The controller device 60 performs various controls of the working machine 1, and is constituted of a semiconductor such as a CPU and an MPU, an electric circuit, an electronic circuit, or the like. An accelerator 65, a mode switch 66, a speed-changing switch 67, and a revolving-speed detector device 68 are connected to the controller device 60.

The mode switch 66 is a switch configured to switch the automatic deceleration (the auto speed reducing) between valid and invalid. For example, the mode switch 66 is a switch configured to be switched between ON and OFF. When the mode switch 66 is ON, the automatic deceleration is switched to be valid. When the mode switch 66 is OFF, the automatic deceleration is switched to be invalid.

The speed-changing switch 67 is provided in the vicinity of the operator seat 8, and is configured to be operated by a driver (an operator). The speed-changing switch 67 is a switch configured to manually switch the traveling motors (the left traveling motor 36L and the right traveling motor 36R) to any one of the first speed and the second speed.

For example, the speed-changing switch 67 is a seesaw switch configured to switch between the first speed side and the second speed side, and is configured to perform an accelerating operation that switches from the first speed side to the second speed side, and to perform a decelerating operation that switches from the second speed to the first speed.

The revolving-speed detector device 68 is constituted of a sensor or the like configured to detect the revolving speed, and detects the current revolving speed of the motors that are the revolving speeds of the motors (the left traveling motor 36L and the right traveling motor 36R).

In particular, the revolving-speed detector device 68 is provided on each of the rotation shafts of the left traveling motor 36L and the right traveling motor 36R, and thus the revolving-speed detector device 68 is configured to detect the motor revolving speed of the left traveling motor 36L (the left motor revolving speed) and the motor revolving speed of the right traveling motor 36R (the right motor revolving speed).

The controller device 60 includes an automatic decelerator portion 61 (may be referred to as an auto speed reducing portion 61). The automatic decelerator portion 61 is constituted of an electric circuit or an electronic circuit provided in the controller device 60 or of a computer program or the like stored in the controller device 60.

The automatic decelerator portion 61 performs the automatic deceleration control when the automatic deceleration is valid, and does not perform the automatic deceleration control when the automatic deceleration is invalid.

Under the automatic deceleration control, when a predetermined condition (an automatic deceleration condition) is satisfied under a state where the traveling motors (the left traveling motor 36L and the right traveling motor 36R) are at the second speed, the traveling motors (the left traveling motor 36L and the right traveling motor 36R) are automatically switched from the second speed to the first speed.

Under the automatic deceleration control, when the automatic deceleration condition is satisfied at least under the state where the traveling motors (the left traveling motor 36L and the right traveling motor 36R) are at the second speed, the controller device 60 demagnetizes the solenoid of the second switching valve 72 to switch the second switching valve 72 from the second position 72*b* to the first position 72*a*. Thus, the traveling motors (the left traveling motor 36L and the right traveling motor 36R) are decelerated from the second speed to the first speed.

That is, when performing the automatic deceleration in the automatic deceleration control, the controller device 60 decelerates both of the left traveling motor 36L and the right traveling motor 36R from the second speed to the first speed.

When a return condition is satisfied after the automatic deceleration is performed, the automatic decelerator portion 61 magnetizes the solenoid of the second switching valve 72 to switch the second switching valve 72 from the first position 72*a* to the second position 72*b*. In this manner, the speeds of the traveling motors (the left traveling motor 36L and the right traveling motor 36R) are increased from the first speed to the second speed, that is, the speeds of the traveling motors are recovered.

That is, when returning from the first speed to the second speed, the controller device 60 accelerates both of the left traveling motor 36L and the right traveling motor 36R from the first speed to the second speed.

When the automatic deceleration is invalid, the controller device 60 performs a manual switching control to switch the traveling motors (the left traveling motor 36L and the right traveling motor 36R) to either one of the first speed and the second speed in response to operation of the speed switching switch 67.

In the manual switching control, when the speed-changing switch 67 is switched to the first speed side, the controller device 60 demagnetizes the solenoid of the second switching valve 72 so that the traveling motors (the left traveling motor 36L and the right traveling motor 36R) are switched to the first speed.

In addition, in the manual switching control, when the speed-changing switch 67 is switched to the second speed side, the controller device 60 demagnetizes the solenoid of the second switching valve 72 so that the traveling motors (the left traveling motor 36L and the right traveling motor 36R) are switched to the second speed.

Now, as shown in FIG. 1, the working machine 1 has an operation detector device 64 and a storage device 69. The operation detector device 64 is a device configured to detect an operation extent of the traveling operation member 59, and is constituted of a potentiometer, for example.

As shown in FIG. 2, when the traveling operation member 59 is gradually inclined from the neutral state, the operation detector device 64 detects the operation extent of the traveling operation member 59 according to the extent of the inclination. The operation detector device 64 is configured to detect the operation extent when the traveling operation member 59 is inclined forward or backward, when the traveling operation member 59 is inclined leftward or rightward, and when the traveling operation member 59 is inclined obliquely.

Figure 3:
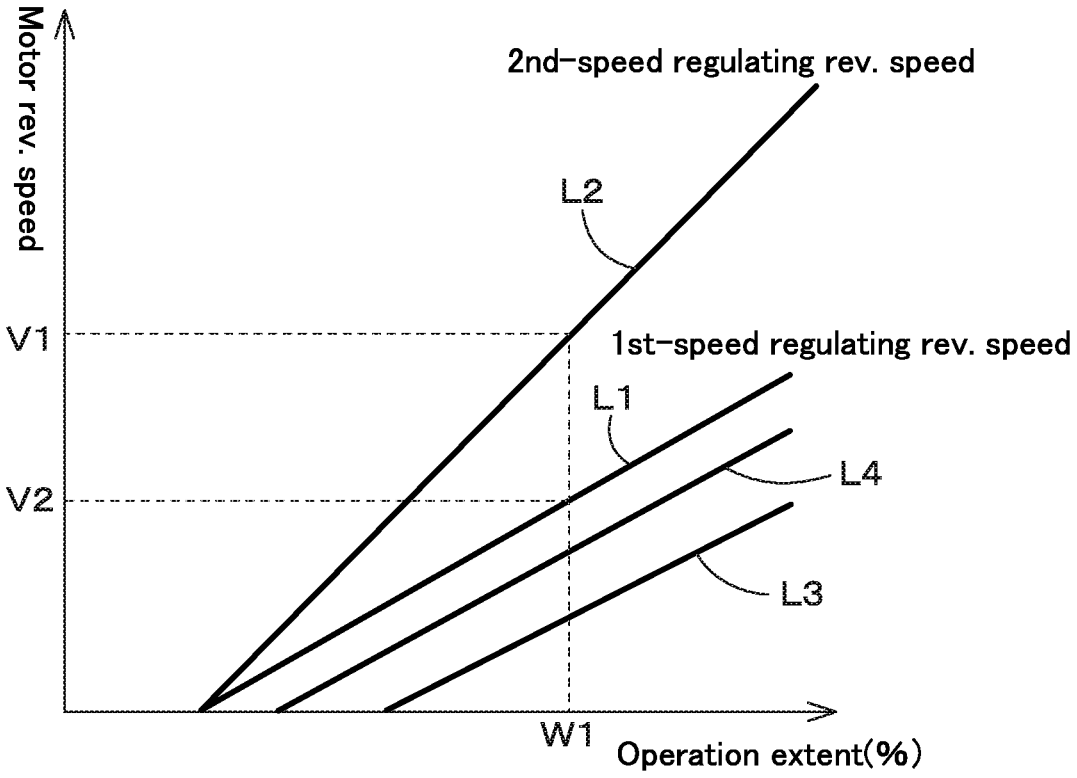
FIG. 3 is a view illustrating an example of first control information according to a first embodiment of the present invention.

The storage device 69 is constituted of a nonvolatile memory or the like, and stores control information (referred to as first control information). As shown in FIG. 3, the control information (the first control information) is information representing the relation between the operation extent of the traveling operation member 59 and the motor revolving speeds of the traveling motors (the left traveling motor 36L and the right traveling motor 36R). The first control information is information represented by numerical values, functions, control lines, tables, or the like.

In particular, when the speed of the working machine 1 is the first speed, the first control information includes the first-speed regulating revolving speed corresponding to the operation extent of the traveling operation member 59, and the first-speed regulating revolving speed is set by the first speed line L1, for example.

In addition, when the speed of the working machine 1 is the second speed, the first control information includes a second-speed regulating revolving speed corresponding to the operation extent of the traveling operation member 59, and the second-speed regulating revolving speed is set by the second speed line L2, for example.

As for the first speed line L1, the amount of increasing in the first-speed regulating revolving speed per predetermined operation extent is smaller than the amount of increasing in the second-speed regulating revolving speed per predetermined operation extent on the second speed line L2. That is, the inclination of the second speed line L2 is larger than the inclination of the first speed line L1.

When the traveling motors (the left traveling motor 36L and the right traveling motor 36R) are at the second speed, the automatic decelerator portion 61 determines the first-speed regulating revolving speed based on the operation extent detected by the operation detector device 64 and the first control information, the first-speed regulating revolving speed being set based on the first speed line L1. And the automatic decelerator portion 61 performs the automatic deceleration (decelerating from the second speed to the first speed) when the motor revolving speed (an actual motor revolving speed) detected by the revolving speed detector device 68 is equal to or less than the first-speed regulating revolving speed.

For example, as shown in FIG. 3, when the operation extent of the traveling operation member 59 is W1 at the second speed, the second-speed regulating revolving speed (the maximum revolving speed) of the traveling motor becomes V1 represented by the second speed line L2.

Here, the automatic decelerator portion 61 starts the automatic deceleration when the actual motor revolving speed of the traveling motor decreases and becomes equal to or lower than V2 represented by the first speed line L1 under the state where the operation extent of the traveling operation member 59 is maintained at W1. On the other hand, after the automatic deceleration, the automatic decelerator portion 61 returns from the first speed to the second speed when the actual motor revolving speed is equal to or more than the return threshold value (a return threshold).

As shown in FIG. 3, the first control information includes a third speed line L3 and a fourth speed line L4 in addition to the first speed line L1 and the second speed line L2. The third speed line L3 is a line for setting a deceleration threshold value (a deceleration threshold) that is equal to or lower than the first-speed regulating revolving speed defined based on the first speed line L1.

The fourth speed line L4 is a line for setting the return threshold value that is equal to or less than the first-speed regulating revolving speed defined by the first speed line L1 and is equal to or larger than the deceleration threshold value defined based on the third speed line L3. In other words, the storage device 69 stores the deceleration threshold value preliminarily determined to be equal to or smaller than the first-speed regulating revolving speed, and stores the return threshold value that is equal to or smaller than the first-speed regulating revolving speed and is equal to or larger than the deceleration threshold value.

The automatic decelerator portion 61 performs the automatic deceleration when the actual motor revolving speed is equal to or less than the deceleration threshold value defined based on the third speed line L3 under the second speed. In addition, after the automatic deceleration, the automatic decelerator portion 61 returns from the first speed to the second speed when the actual motor revolving speed is equal to or more than the return threshold value defined based on the fourth speed line L4.

Figure 4:
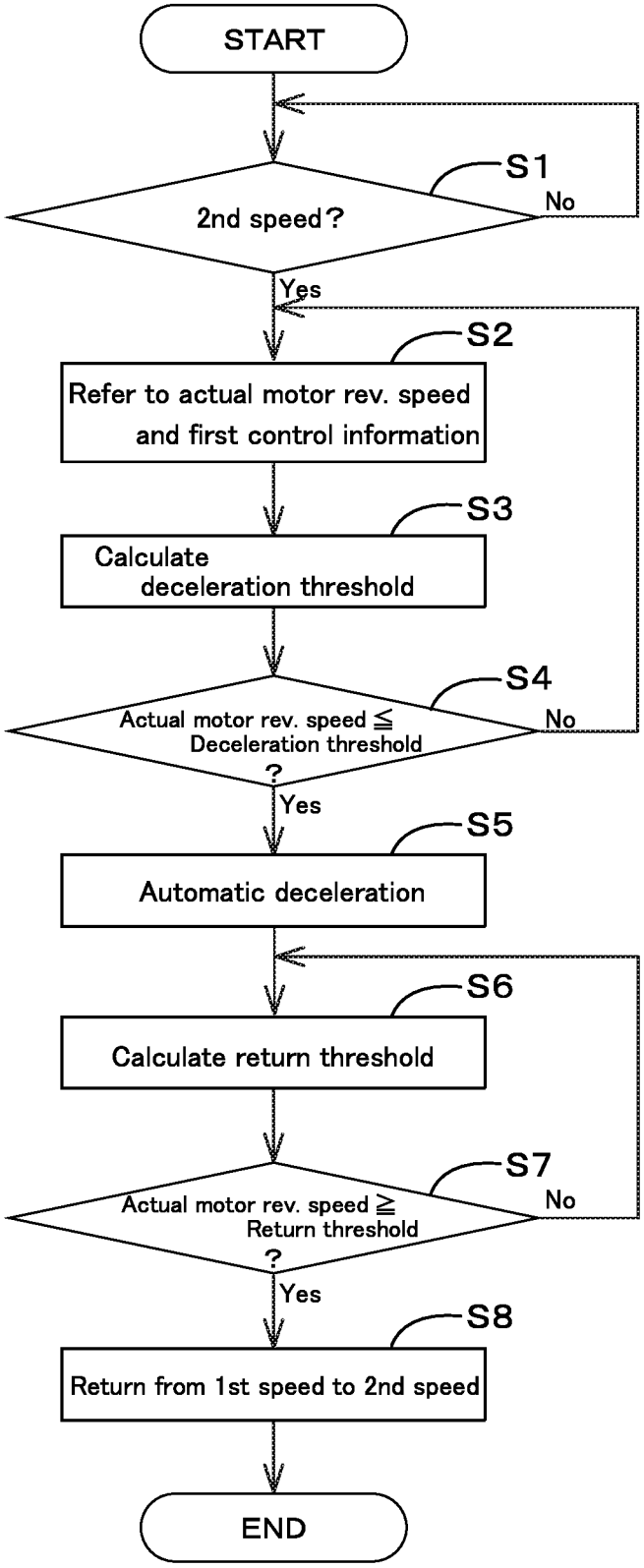
FIG. 4 is a view showing a process of an auto speed reducing portion according to the first embodiment.

FIG. 4 is a view summarizing the processing in the automatic decelerator portion 61.

As shown in FIG. 4, under the state where the automatic deceleration is valid and the traveling motor is at the second speed (step S1, Yes), the automatic decelerator portion 61 refers to the actual motor revolving speed detected by the revolving speed detector device 68 and the first control information (step S2).

The automatic decelerator portion 61 calculates the deceleration threshold value based on the operation extent detected by the operation detector device 64 and on the third speed line L3 (step S3).

The automatic decelerator portion 61 judges whether or not the actual motor revolving speed is equal to or less than the deceleration threshold value (step S4).

When the actual motor revolving speed is equal to or smaller than the deceleration threshold value (step S4, Yes), the automatic decelerator portion 61 performs the automatic deceleration (step S5).

After performing the automatic deceleration, the automatic decelerator portion 61 calculates the return threshold value based on the operation extent detected by the operation detector device 64 and on the fourth speed line L4 (step S6).

The automatic decelerator portion 61 judges whether or not the actual motor revolving speed is equal to or larger than the return threshold value (step S7).

When the actual motor revolving speed is equal to or lower than the return threshold value (step S7, Yes), the automatic decelerator portion 61 returns from the first speed to the second speed (step S8).

In addition, the automatic decelerator portion 61 performs the automatic deceleration when either one of the left motor revolving speed of the left traveling motor 36L and the right motor revolving speed of the right traveling motor 36R is equal to or less than the first-speed regulating revolving speed under the state of performing the spin turn(the pivot turn) in which one of the left traveling motor 36L and the right traveling motor 36R rotates forward and the other traveling motor reversely rotates.

That is, in the case of the pivot turn, the automatic deceleration is performed when one of the left motor speed and the right motor speed becomes equal to or less than the motor revolving speed set by the third speed line L3 (less than the deceleration threshold value).

In addition, in the case of the pivot turn, the automatic decelerator portion 61 returns from the first speed to the second speed when the revolving speeds of both of the left traveling motor 36L and the right traveling motor 36R are equal to or larger than the return threshold value set by the fourth speed line L4.

In the above-described embodiment, when both of the pair of traveling motors (the left traveling motor 36L and the right traveling motor 36R) are at the second speed, the automatic decelerator portion 61 automatically decelerates from the second speed to the first speed. However, the automatic decelerator portion 61 may perform the automatic deceleration when either one of the pair of traveling motors (the left traveling motor 36L and the right traveling motor 36R) is at the second speed.

In addition, the automatic decelerator portion 61 may return from the first speed to the second speed after either one of the pair of traveling motors (the left traveling motor 36L and the right traveling motor 36R) is automatically decelerated.

The working machine 1 includes the machine body 2, the pair of traveling devices 5L and 5R, the traveling operation member 59, the pair of traveling motors (the left traveling motor 36L and the right traveling motor 36R), the pair of traveling pumps 53L and 53R, the revolving speed detector device 68, the operation detector device 64, the control device 60 having the automatic decelerator portion 61, and the storage device 69. When at least one of the pair of traveling motors (the left traveling motor 36L and the right traveling motor 36R) is at the second speed, the automatic decelerator portion 61 obtains the first-speed regulating revolving speed based on the operation extent detected by the operation detector device 64 and on the first control information, and performs the automatic deceleration when the motor revolving speed detected by the revolving speed detector device 68 is equal to or less than the first-speed regulating revolving speed.

According to this configuration, under the state where the first-speed regulating revolving speed corresponding to the operation extent at the first speed, for example, the maximum speed of the first speed corresponding to the operation extent is set, the automatic deceleration is performed when the revolving speed becomes lower than the maximum revolving speed of the first speed (becomes equal to or smaller than the first-speed regulating revolving speed) under the second speed, and thereby the deceleration is smoothly and automatically performed without deteriorating the workability.

After the automatic deceleration, the automatic decelerator portion 61 returns from the first speed to the second speed when the motor revolving speed detected by the revolving speed detector device 68 is equal to or more than the return threshold value.

According to this configuration, it is possible to automatically return from the first speed to the second speed when the motor revolving speed become equal to or more than the return threshold value in the automatic deceleration, and also in this point, the operation can be smoothly performed without impairing the workability.

The storage device 69 is configured to store the deceleration threshold preliminarily determined to be equal to or smaller than the first-speed regulating revolving speed, and performs the automatic deceleration when the motor revolving speed detected by the revolving speed detector device 68 is equal to or smaller than the deceleration threshold value.

According to this configuration, the automatic deceleration can be automatically performed at least when the motor revolving speed becomes lower than the maximum revolving speed of the first speed (the first-speed regulating revolving speed) (becomes equal to or smaller than the deceleration threshold value).

The storage device 69 has the return threshold value that is equal to or less than the first-speed regulating revolving speed and is equal to or greater than the deceleration threshold value. The working machine 1 returns from the first speed to the second speed when the motor revolving speed detected by the revolving speed detector device 68 is equal to or larger than the return threshold value.

According to this configuration, after the automatic deceleration, the motor revolving speed can be smoothly returned from the first speed to the second speed at least when the motor revolving speed is increasing toward the maximum revolving speed of the first speed (the first-speed regulating revolving speed).

In the case of the pivot turn in which one of the pair of traveling motors (the left traveling motor 36L and the right traveling motor 36R) is rotated normally and the other traveling motor is rotated reversely, the automatic decelerator portion 61 performs the automatic deceleration when any one of the motor revolving speeds of the traveling motors is equal to or less than the first-speed regulating revolving speed.

According to this configuration, the automatic deceleration can be quickly performed when a load is temporarily applied to either one of the pair of traveling motors (the left traveling motor 36L and the right traveling motor 36R) under the state where the spin turn is performed.

In the case of the spin turn in which one of the pair of traveling motors (the left traveling motor 36L and the right traveling motor 36R) is rotated normally and the other traveling motor is rotated reversely, the automatic decelerator portion 61 returns from the first speed to the second speed when the motor revolving speeds of both the pair of traveling motors are equal to or higher than the return threshold value.

According to this configuration, the motor speed can smoothly return to the second speed when any one of loads applied to the pair of traveling motors (the left traveling motor 36L and the right traveling motor 36R) is reduced under the spin turn.

Second Embodiment

Figure 5:
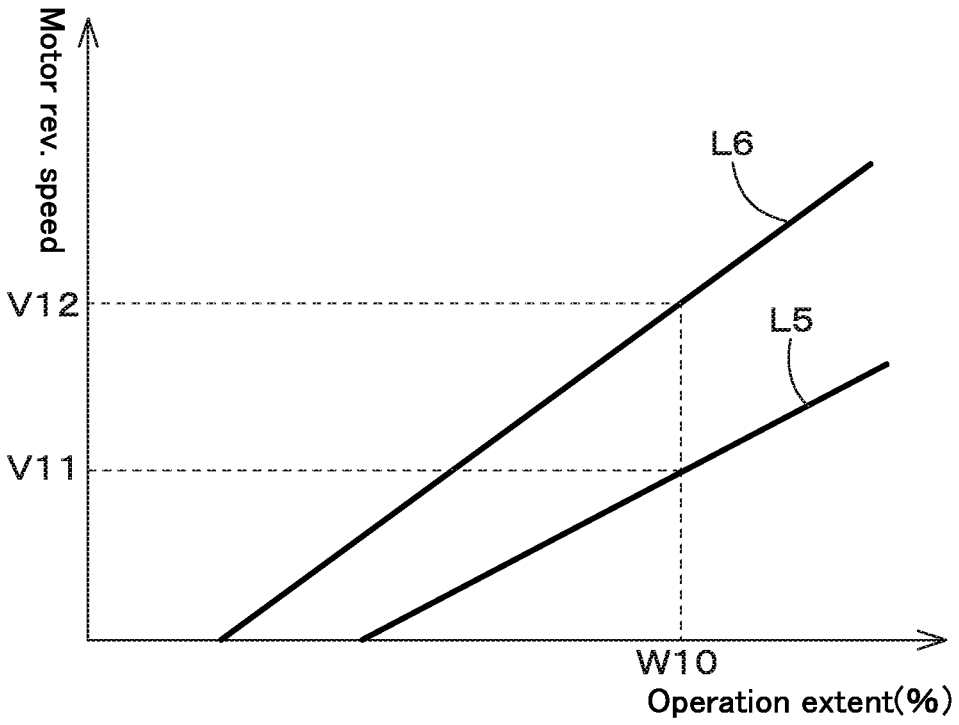
FIG. 5 is a view illustrating an example of second control information according to a second embodiment of the present invention.

FIG. 5 shows control information (second control information) according to a second embodiment of the present invention. In the second embodiment, the descriptions of configurations same as those of the first embodiment will be omitted. The control information according to the second embodiment is also information representing the relation between the operation extent of the traveling operation member 59 and the motor revolving speeds of the travel motors (the left travel motor 36L and the right travel motor 36R).

The second control information is information represented by numerical values, functions, control lines, tables, or the like.

The storage device 69 stores, as the second control information, a fifth speed line L5 and a sixth speed line L6. The fifth speed line L5 is a line that represents the relation between the operation extent of the traveling operation member 59, the motor revolving speed, and the deceleration threshold value. The sixth speed line L6 is a line that represents the relation between the operation extent of the traveling operation member 59, the motor revolving speed, and the return threshold value.

The automatic decelerator portion 61 obtains the deceleration threshold value based on the operation extent detected by the operation detector device 64 and on the fifth speed line L5 when the traveling motors (the left traveling motor 36L and the right traveling motor 36R) are at the second speed and both of the traveling motors (the left traveling motor 36L and the right traveling motor 36R) rotate normally (forward), and performs the automatic deceleration when the actual motor revolving speed is equal to or less than the deceleration threshold value.

For example, the automatic decelerator portion 61 has the deceleration threshold value of V11 represented by the fifth speed line L5 when the operation extent of the traveling operation member 59 is W10 as shown in FIG. 5.

Here, when the actual motor revolving speeds of both the left traveling motor 36L and the right traveling motor 36R are reduced during the working machine 1 travels forward (travels straight) under the state where the operation extent of the traveling operation member 59 is maintained at W10, and the automatic decelerator portion 61 performs the automatic deceleration when the actual motor revolving speeds of both the traveling motors become equal to or less than the deceleration threshold value V11.

On the other hand, the automatic decelerator portion 61 obtains the return threshold value based on the operation extent detected by the operation detector device 64 and on the sixth speed line L6 when the traveling motors (the left traveling motor 36L and the right traveling motor 36R) are at the first speed and both the traveling motors (the left traveling motor 36L and the right traveling motor 36R) are rotated normally (travel forward) after the automatic deceleration. And, the automatic decelerator portion 61 returns the traveling motors from the first speed to the second speed when the actual motor revolving speeds are equal to or larger than the return threshold value V12.

For example, as shown in FIG. 5, the automatic decelerator portion 61 returns the traveling motors from the first speed to the second speed when the actual motor revolving speed is increased during the forward traveling of the working machine 1 and the actual motor revolving speed of any one of the left traveling motor 36L and the right traveling motor 36R becomes equal to or larger than the return threshold value V12 after the automatic deceleration under the state where the operation extent is maintained at W10.

In the second embodiment, the automatic deceleration and the return are described exemplifying a case where both the traveling motors (the left traveling motor 36L and the right traveling motor 36R) rotate normally (forward). The operation is the same even when both of the traveling motors (the left traveling motor 36L and the right traveling motor 36R) are rotated reversely (travel backward). That is, in the second embodiment, the configuration of the normally rotating (the forward traveling) is replaced with the configuration of the reversely rotating (the backward traveling).

The working machine includes the machine body 2, the pair of traveling devices 5L and 5R, the traveling operation member 59, the pair of traveling motors (the left traveling motor 36L and the right traveling motor 36R), the pair of traveling pumps 53L and 53R, the revolving speed detector device 68, the operation detector device 64, the controller device 60 having an automatic decelerator portion 61, and the storage device 69 configured to store the second control information.

When at least one of the pair of traveling motors is at the second speed and both of the pair of traveling motors are rotating normally or reversely, the automatic decelerator portion 61 obtains the deceleration threshold value based on the operation extent detected by the operation detector device 64 and on the second control information, and performs the automatic deceleration when the motor revolving speed detected by the revolving speed detector device 68 is equal to or less than the deceleration threshold value.

According to this configuration, the automatic deceleration can be quickly performed when a load is applied under the state where the working machine 1 rotates normally (travels forward) or rotates reversely (travels backward) at the second speed.

The storage device 69 stores the second control information representing a relation between the operation extent of the traveling operation member 59, the motor revolving speed, and the return threshold value. The automatic decelerator portion 61 calculates the return threshold value based on the operation extent detected by the operation detector device 64 and on the second control information when both of the pair of traveling motors rotate normally or rotate reversely after the automatic deceleration, and returns the traveling motors from the first speed to the second speed when the motor revolving speed detected by the revolving speed detector device 68 is equal to or larger than the return threshold value.

According to this configuration, after the automatic deceleration in the forward traveling or the backward traveling, it is possible to quickly perform the returning when the motor revolving speed becomes equal to or larger than the return threshold value.

As described above, since the second speed only needs to be higher than the first speed, the working machine is not limited to the two shift speeds, and can employ even the multiple shift speeds (a plurality of shift steps).

In the embodiment described above, the left traveling motor 36L and the right traveling motor 36R are simultaneously switched to the first speed and to the second speed, and the automatic deceleration is simultaneously performed on the left traveling motor 36L and the right traveling motor 36R.

However, the automatic deceleration may be performed under the state where at least one of the left traveling motor 36L and the right traveling motor 36R is switched to the first speed or to the second speed and at least one of the left traveling motor 36L and the right traveling motor 36R is at the second speed.

In addition, each of the traveling motors (the left traveling motor 36L and the right traveling motor 36R) may be constituted of an axial piston motor or a radial piston motor. Regardless of whether the traveling motor is constituted of the axial piston motor or the radial piston motor, it is possible to switch to the first speed by increasing the motor capacity and to switch to the second speed by reducing the motor capacity.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine comprising:

a machine body;

a traveling device provided on the machine body;

a traveling motor configured to provide power to the traveling device and to be switched between a first speed and a second speed higher than the first speed;

a traveling operation member to be operated by an operator;

an operation detector to detect an operation extent of the traveling operation member;

a traveling pump driven in response to the operation extent to supply operation fluid to the traveling motor;

a revolution detector to detect a motor revolving speed of the traveling motor; and a controller configured to switch the traveling motor from the second speed to the first speed when the motor revolving speed is equal to or less than a deceleration threshold, and then to switch the traveling motor from the first speed to the second speed when the motor revolving speed is equal to or greater than a return threshold, wherein the controller is configured to calculate the deceleration threshold and the return threshold based on the operation extent of the traveling operation member.

2. The working machine according to claim 1, wherein the deceleration threshold is less than the return threshold.

3. The working machine according to claim 1, wherein the deceleration threshold is less than a first top revolving speed of the traveling motor switched to the first speed, for the operation extent of the traveling operation member.

4. The working machine according to claim 3, wherein the controller is configured to calculate the first top revolving speed based on the operation extent of the traveling operation member.

5. The working machine according to claim 1, wherein a first top revolving speed of the traveling motor switched to the first speed is less than a second top revolving speed of the traveling motor switched to the second speed, for the operation extent of the traveling operation member.

6. The working machine according to claim 1, comprising:

a switch coupled to the controller and configured to allow the operator to select whether or not the traveling motor is switched between the first speed and a second speed.

7. A working machine comprising:

a machine body;

first and second traveling devices provided on the machine body;

first and second traveling motors configured to provide power to the first and second traveling devices, respectively, and to be switched between a first speed and a second speed higher than the first speed;

a traveling operation member to be operated by an operator;

an operation detector to detect an operation extent of the traveling operation member;

first and second traveling pumps driven in response to the operation extent to supply operation fluid to the first and second traveling motors, respectively;

a revolution detector to detect a first motor revolving speed of the first traveling motor and a second motor revolving speed of the second traveling motor; and a controller configured to switch both of the first and second traveling motors from the second speed to the first speed when the first traveling motor rotates forward and the second traveling motor rotates backward, and at least one of the first motor revolving speed and the second motor revolving speed is equal to or less than a first deceleration threshold, wherein the controller is configured to switch both of the first and second traveling motors from the first speed to the second speed when both of the first motor revolving speed and the second motor revolving speed are equal to or greater than a first return threshold after having switched both of the first and second traveling motors from the second speed to the first speed, and the controller is configured to calculate the first deceleration threshold and the first return threshold based on the operation extent of the traveling operation member.

8. The working machine according to claim 7, wherein the first deceleration threshold is less than the first return threshold.

9. The working machine according to claim 7, wherein the first deceleration threshold is less than a first top revolving speed of the first and second traveling motors switched to the first speed, for the operation extent of the traveling operation member.

10. The working machine according to claim 9, wherein the controller is configured to calculate the first top revolving speed based on the operation extent of the traveling operation member.

11. The working machine according to claim 7, wherein the controller is configured to switch both of the first and second traveling motors from the second speed to the first speed when both of the first and second traveling motors rotate forward or backward, and both of the first motor revolving speed and the second motor revolving speed are equal to or less than a second deceleration threshold.

12. The working machine according to claim 11, wherein the controller is configured to switch both of the first and second traveling motors from the first speed to the second speed when at least one of the first motor revolving speed and the second motor revolving speed is equal to or greater than a second return threshold after having switched both of the first and second traveling motors from the second speed to the first speed.

13. The working machine according to claim 12, wherein the first return threshold is different from the second return threshold.

14. The working machine according to claim 11, wherein the first deceleration threshold is different from the second deceleration threshold.

15. A working machine comprising:

a machine body;

first and second traveling devices provided on the machine body;

first and second traveling motors configured to provide power to the first and second traveling devices, respectively, and to be switched between a first speed and a second speed higher than the first speed;

a traveling operation member to be operated by an operator;

an operation detector to detect an operation extent of the traveling operation member;

first and second traveling pumps driven in response to the operation extent to supply operation fluid to the first and second traveling motors, respectively;

a revolution detector to detect a first motor revolving speed of the first traveling motor and a second motor revolving speed of the second traveling motor; and a controller configured to switch both of the first and second traveling motors from the second speed to the first speed when both of the first and second traveling motors rotate forward or backward, and both of the first motor revolving speed and the second motor revolving speed are equal to or less than a second deceleration threshold, wherein the controller is configured to switch both of the first and second traveling motors from the first speed to the second speed when at least one of the first motor revolving speed and the second motor revolving speed is equal to or greater than a second return threshold after having switched both of the first and second traveling motors from the second speed to the first speed, and the controller is configured to calculate the second deceleration threshold and the second return threshold based on the operation extent of the traveling operation member.

16. The working machine according to claim 15, comprising:

a switch coupled to the controller and configured to allow the operator to select whether or not the traveling motor is switched between the first speed and a second speed.

17. A working machine comprising:

a machine body;

first and second traveling devices provided on the machine body;

first and second traveling motors configured to provide power to the first and second traveling devices, respectively, and to be switched between a first speed and a second speed higher than the first speed;

a traveling operation member to be operated by an operator;

an operation detector to detect an operation extent of the traveling operation member;

first and second traveling pumps driven in response to the operation extent to supply operation fluid to the first and second traveling motors, respectively;

a revolution detector to detect a first motor revolving speed of the first traveling motor and a second motor revolving speed of the second traveling motor; and a controller configured to switch both of the first and second traveling motors from the second speed to the first speed when the first traveling motor rotates forward and the second traveling motor rotates backward, and at least one of the first motor revolving speed and the second motor revolving speed is equal to or less than a first deceleration threshold, wherein the deceleration threshold is less than a first top revolving speed of the traveling motor switched to the first speed, for the operation extent of the traveling operation member, and the controller is configured to calculate the first top revolving speed based on the operation extent of the traveling operation member.

18. The working machine according to claim 17, wherein the deceleration threshold is less than the return threshold.

19. The working machine according to claim 17, wherein a first top revolving speed of the traveling motor switched to the first speed is less than a second top revolving speed of the traveling motor switched to the second speed, for the operation extent of the traveling operation member.

20. The working machine according to claim 17, wherein the controller is configured to calculate the deceleration threshold and the return threshold based on the operation extent of the traveling operation member.

21. The working machine according to claim 17, comprising:

a switch coupled to the controller and configured to allow the operator to select whether or not the traveling motor is switched between the first speed and a second speed.

22. A working machine comprising:

a machine body;

first and second traveling devices provided on the machine body;

first and second traveling motors configured to provide power to the first and second traveling devices, respectively, and to be switched between a first speed and a second speed higher than the first speed;

a traveling operation member to be operated by an operator;

an operation detector to detect an operation extent of the traveling operation member;

first and second traveling pumps driven in response to the operation extent to supply operation fluid to the first and second traveling motors, respectively;

a revolution detector to detect a first motor revolving speed of the first traveling motor and a second motor revolving speed of the second traveling motor; and a controller configured to switch both of the first and second traveling motors from the second speed to the first speed when the first traveling motor rotates forward and the second traveling motor rotates backward, and at least one of the first motor revolving speed and the second motor revolving speed is equal to or less than a first deceleration threshold, wherein the controller is configured to switch both of the first and second traveling motors from the first speed to the second speed when both of the first motor revolving speed and the second motor revolving speed are equal to or greater than a first return threshold after having switched both of the first and second traveling motors from the second speed to the first speed, the first deceleration threshold is less than a first top revolving speed of the first and second traveling motors switched to the first speed, for the operation extent of the traveling operation member, and the controller is configured to calculate the first top revolving speed based on the operation extent of the traveling operation member.

23. The working machine according to claim 22, wherein the first deceleration threshold is less than the first return threshold.

24. The working machine according to claim 22, wherein the controller is configured to calculate the first deceleration threshold and the first return threshold based on the operation extent of the traveling operation member.

25. The working machine according to claim 22, wherein the controller is configured to switch both of the first and second traveling motors from the second speed to the first speed when both of the first and second traveling motors rotate forward or backward, and both of the first motor revolving speed and the second motor revolving speed are equal to or less than a second deceleration threshold.

26. The working machine according to claim 25, wherein the controller is configured to switch both of the first and second traveling motors from the first speed to the second speed when at least one of the first motor revolving speed and the second motor revolving speed is equal to or greater than a second return threshold after having switched both of the first and second traveling motors from the second speed to the first speed.

27. The working machine according to claim 25, wherein the first deceleration threshold is different from the second deceleration threshold.

* * * * *